US011251569B2

(12) United States Patent
Liao et al.

(10) Patent No.: US 11,251,569 B2
(45) Date of Patent: Feb. 15, 2022

(54) ELECTRICAL CONNECTOR

(71) Applicant: LOTES CO., LTD, Keelung (TW)

(72) Inventors: Jie Liao, Keelung (TW); Lei Wan, Keelung (TW); Chang Wei Ke, Keelung (TW); Jun Kang Zhong, Keelung (TW)

(73) Assignee: LOTES CO., LTD, Keelung (TW)

( * ) Notice: Subject to any disclaimer, the term of this patent is extended or adjusted under 35 U.S.C. 154(b) by 63 days.

(21) Appl. No.: 16/992,321

(22) Filed: Aug. 13, 2020

(65) Prior Publication Data

US 2021/0218191 A1 Jul. 15, 2021

(30) Foreign Application Priority Data

Jan. 13, 2020 (CN) ..... 202010031183.9

(51) Int. Cl.

| | |
|---|---|
| ***H01R 13/64*** | (2006.01) |
| ***H01R 13/6471*** | (2011.01) |
| ***H01R 13/24*** | (2006.01) |
| ***H01R 13/6474*** | (2011.01) |
| ***H01R 13/6585*** | (2011.01) |

(52) U.S. Cl.

CPC ..... *H01R 13/6471* (2013.01); *H01R 13/24* (2013.01); *H01R 13/6474* (2013.01); *H01R 13/6585* (2013.01)

(58) Field of Classification Search

CPC ..... H01R 13/6471; H01R 13/6461; H01R 13/6473; H01R 13/6474; H01R 13/6585; H01R 13/24

USPC ..... 439/941, 660, 607.35, 607.4

See application file for complete search history.

(56) References Cited

U.S. PATENT DOCUMENTS 6,270,381 B1 * 8/2001 Adriaenssens ..... H01R 13/6467 333/1

7,670,199 B2 * 3/2010 Nagata ..... H01R 13/6474 439/92

(Continued)

FOREIGN PATENT DOCUMENTS

CN 102255200 A * 11/2011 ..... H01R 12/725

CN 103560360 A 2/2014

(Continued)

*Primary Examiner* — Marcus E Harcum

(74) *Attorney, Agent, or Firm* — Locke Lord LLP; Tim Tingkang Xia, Esq.

(57) ABSTRACT

An electrical connector includes an insulating body accommodating multiple first terminals. The first terminals include first and second differential signal pairs. No ground terminal is provided at one side of the first differential signal pair. Both sides of the second differential signal pair have ground terminals. The impedance of the first differential signal pair is adjusted by having a distance between the first differential signal pair and the first ground terminal less than a distance between the second differential signal pair and the first ground terminal, or by having a width of a portion of the first differential signal pair exposed out of the insulating body greater than a width of a portion of the second differential signal pair exposed out of the insulating body, or by having a distance between terminals of the first differential signal pair less than a distance between terminals of the second differential signal pair.

20 Claims, 7 Drawing Sheets

(56) References Cited

U.S. PATENT DOCUMENTS

| | | | | |
|---|---|---|---|---|
| 8,342,888 | B2 * | 1/2013 | Amleshi | H01R 13/658 439/676 |
| 8,485,851 | B2 * | 7/2013 | Kondo | H01R 27/00 439/660 |
| 9,948,046 | B1 * | 4/2018 | Peng | H01R 13/6586 |
| 10,063,012 | B2 * | 8/2018 | Chang | H01R 13/665 |
| 10,116,100 | B2 * | 10/2018 | Feng | H01R 13/6596 |
| 10,651,602 | B2 * | 5/2020 | Feng | H01R 13/405 |
| 10,998,679 | B2 * | 5/2021 | Long | H01R 13/6477 |
| 2007/0149058 | A1 * | 6/2007 | Saito | H01R 12/712 439/108 |
| 2010/0248552 | A1 * | 9/2010 | He | H01R 13/516 439/638 |
| 2010/0255731 | A1 * | 10/2010 | Oyake | H01R 13/6473 439/660 |
| 2012/0115371 | A1 * | 5/2012 | Chuang | H01R 12/724 439/660 |
| 2012/0142200 | A1 * | 6/2012 | Ito | H01R 13/6471 439/65 |
| 2015/0147915 | A1 * | 5/2015 | Taniguchi | H01R 13/6461 439/660 |
| 2016/0079709 | A1 * | 3/2016 | Su | H01R 13/6477 439/660 |
| 2016/0126658 | A1 * | 5/2016 | Yamakami | H01R 12/724 439/660 |
| 2020/0136315 | A1 * | 4/2020 | Tanaka | H01R 13/6585 |

FOREIGN PATENT DOCUMENTS

| | | | | |
|---|---|---|---|---|
| CN | 109088199 | A | | 12/2018 |
| CN | 110311242 | A | * | 10/2019 |
| CN | 110336162 | A | * | 10/2019 |

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN202010031183.9 filed in China on Jan. 13, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector transmitting high frequency signals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

HDMI is the abbreviated term of high definition multimedia interface, which is a digital audio/video interface technology suited to a dedicated digital interface for video transmission, and may transmit audio and video signals simultaneously with a highest digital transmission speed of 48 Gbps (version 2.1). The HDMI connector before HDMI 2.1 only provides signal transmission channels of three differential signal pairs, with a highest digital transmission speed of 36 Gbps. The HDMI 2.1 provides signal transmission channels of four differential signal pairs, with the highest digital transmission speed of 48 Gbps. However, one side of the newly opened differential signal pair is not provided with any ground terminal, and each of two sides of each of the other three differential signal pairs is provided with a ground terminal, resulting in the impedance not matching and not meeting the standard, and further affecting the transmission speed of HDMI 2.1.

Currently, to adjust the deficiency of impedance not matching in the HDMI 2.1, the four differential signal pairs are all adjusted. The structures of the four differential signal pairs are provided to be identical to ensure the signal transmission of the connector is consistent, improving the high frequency transmission effect, reducing crosstalk, and adjusting impedance. However, adjusting the four differential signal pairs together does not make the impedance matching reach the ideal state.

Alternatively, the impedance of the differential signal pair may be adjusted by providing an additional grounding member at the side of the differential signal pair not provided with the ground terminal, thus matching the impedance of the other three differential signal pairs, such that the structures of the differential signal pair and the other three differential signal pairs are provided to be identical. However, the grounding member is a component additionally provided, and in design, there is a need to consider the connection relationships between all components, the spatial arrangement between all components, and the high frequency effects, such that the structure of the connector becomes more complicated, processing and mounting are more complicated, and the cost is increased.

Therefore, a heretofore unaddressed need to design a new electrical connector exists in the art to address the aforementioned deficiencies and inadequacies.

SUMMARY

The present invention is directed to an electrical connector, in which the structure of the differential signal pair with one side not provided with any ground terminal is adjusted to be different from the structures of other differential signal pairs with two sides provided with ground terminals, finally facilitating same impedance of the two different differential signal pairs, thus solving the deficiency of impedance not matching of the electrical connector.

To achieve the foregoing objective, the present invention adopts the following technical solutions.

An electrical connector includes: an insulating body; and a plurality of first terminals, accommodated in the insulating body, and comprising a first differential signal pair, a second differential signal pair, and a plurality of first ground terminals, wherein the first differential signal pair has a first differential terminal and a second differential terminal, the second differential signal pair has a third differential terminal and a fourth differential terminal, the second differential terminal is closer to the third differential terminal than the first differential terminal, one of the first ground terminals exists between and is adjacent to the second differential terminal and the third differential terminal, no ground terminal is provided at a side of the first differential terminal away from the second differential terminal, another one of the first ground terminals is provided at a side of the fourth differential terminal away from the third differential terminal, and a distance between the second differential terminal and the one of the first ground terminals adjacent thereto is less than a distance between the third differential terminal and the one of the first ground terminals adjacent thereto.

In certain embodiments, each of the first differential terminal and the second differential terminal has a first front portion at least partially exposed out of the insulating body, a first connecting portion connected to the first front portion and retained to the insulating body, and a first soldering portion connected to the first connecting portion, each of the third differential terminal and the fourth differential terminal has a second front portion at least partially exposed out of the insulating body, a second connecting portion connected to the second front portion and retained to the insulating body, and a second soldering portion connected to the second connecting portion, and a distance between the first front portion of the second differential terminal and the one of the first ground terminals adjacent thereto is less than a distance between the second front portion of the third differential terminal and the one of the first ground terminals adjacent thereto.

In certain embodiments, the first front portion comprises a first contact portion and a first extending portion connected to the first contact portion, the first extending portion is connected to the first connecting portion, the second front portion comprises a second contact portion and a second extending portion connected to the second contact portion, the second extending portion is connected to the second connecting portion, and a distance between the first extending portion of the second differential terminal and the one of the first ground terminals adjacent thereto is less than a distance between the second extending portion of the third differential terminal and the one of the first ground terminals adjacent thereto.

In certain embodiments, a width of the first extending portion is less than a width of the first contact portion, a width of the second extending portion is less than a width of the second contact portion, and the width of the first extending portion is greater than the width of the second extending portion.

In certain embodiments, a chamfer exists between the first extending portion and the first contact portion, the width of the first extending portion is 0.6 to 0.9 times the width of the first contact portion, and the width of the first extending portion is smoothly reduced backward from front thereof.

In certain embodiments, a side edge of the first extending portion close to the one of the first ground terminals adjacent thereto extends straightly and then obliquely backward from front thereof.

In certain embodiments, the insulating body has a base and a tongue protruding out of the base, the first terminals are arranged in a row and partially exposed to an upper surface of the tongue, each of the first front portions is at least partially exposed to the upper surface of the tongue, at least some of the second front portions are exposed to the upper surface of the tongue, the first connecting portion and the second connecting portion are retained to the base, and a distance between the two first front portions is less than a distance between the two second front portions.

In certain embodiments, the first front portion comprises a first contact portion and a first extending portion connected to the first contact portion, the first extending portion is connected to the first connecting portion, the second front portion comprises a second contact portion and a second extending portion connected to the second contact portion, the second extending portion is connected to the second connecting portion, the first extending portion extends horizontally backward from a tail end of the first contact portion, the first connecting portion bends and extends backward and downward from a tail end of the first extending portion, the first soldering portion bends and extends backward from a tail end of the first connecting portion, the second contact portion and the first contact portion are located at a same first height of the tongue, the second extending portion and the first extending portion are located at a same second height of the tongue, and the second connecting portion and the second soldering portion respectively overlap with projections of the first connecting portion and the first soldering portion along an arrangement direction of the first terminals.

In certain embodiments, the electrical connector further includes a plurality of second terminals, wherein each of the second terminals is alternately arranged with the first terminals, the second terminals are arranged in a row and partially exposed to a lower surface of the tongue, the second terminals comprise two third differential signal pairs and a plurality of second ground terminals, each of two sides of each of the third differential signal pairs is provided with one of the second ground terminals, each of the third differential signal pairs comprises two fifth differential terminals, each of the fifth differential terminals has a third front portion at least partially exposed to the lower surface of the tongue, a third connecting portion connected to the third front portion and retained to the base, and a third soldering portion connected to the third connecting portion, the third front portions of the two third differential signal pairs are located at a same height of the tongue, the third connecting portion and the third soldering portion respectively overlap with projections of the first connecting portion and the first soldering portion along the arrangement direction of the first terminals, a distance between each of the fifth differential terminals and a corresponding one of the second ground terminals adjacent thereto is equal to the distance between the third differential terminal and the one of the first ground terminals adjacent thereto, and is greater than the distance between the second differential terminal and the one of the first ground terminals adjacent thereto.

In certain embodiments, a width of the first differential terminal is greater than a width of the fourth differential terminal, or a width of the second differential terminal is greater than a width of the third differential terminal.

An electrical connector includes: an insulating body; and a plurality of first terminals, accommodated in the insulating body, and comprising a first differential signal pair, a second differential signal pair, and a plurality of first ground terminals, wherein the first differential signal pair has a first differential terminal and a second differential terminal, the second differential signal pair has a third differential terminal and a fourth differential terminal, the second differential terminal is closer to the third differential terminal than the first differential terminal, at least one of the first ground terminals exists between the second differential terminal and the third differential terminal, no ground terminal is provided at a side of the first differential terminal away from the second differential terminal, and another one of the first ground terminals is provided at a side of the fourth differential terminal away from the third differential terminal; wherein each of the first differential terminal and the second differential terminal has a first front portion at least partially exposed out of the insulating body, a first connecting portion connected to the first front portion and retained to the insulating body, and a first soldering portion connected to the first connecting portion, each of the third differential terminal and the fourth differential terminal has a second front portion at least partially exposed out of the insulating body, a second connecting portion connected to the second front portion and retained to the insulating body, and a second soldering portion connected to the second connecting portion, and a width of a portion of the first front portion of the second differential terminal exposed out of the insulating body is greater than a width of a portion of the second front portion of the third differential terminal exposed out of the insulating body.

In certain embodiments, the first front portion comprises a first contact portion and a first extending portion connected to the first contact portion, the first extending portion is connected to the first connecting portion, the second front portion comprises a second contact portion and a second extending portion connected to the second contact portion, the second extending portion is connected to the second connecting portion, a width of the first extending portion is less than a width of the first contact portion, a width of the second extending portion is less than a width of the second contact portion, and a width of a portion of the first extending portion exposed out of the insulating body is greater than a width of a portion of the second extending portion exposed out of the insulating body.

In certain embodiments, a chamfer exists between the first extending portion and the first contact portion, the width of the first extending portion is 0.6 to 0.9 times the width of the first contact portion, and the width of the first extending portion is smoothly reduced backward from front thereof.

In certain embodiments, a distance between the two first extending portions is less than a distance between the two second extending portions.

An electrical connector includes: an insulating body; and a plurality of first terminals, accommodated in the insulating body, and comprising a first differential signal pair, a second differential signal pair, and a plurality of first ground terminals, wherein one side of the first differential signal pair is not provided with any ground terminal, the first differential signal pair has a first differential terminal and a second differential terminal, each of two sides of the second differential signal pair is provided with one of the first ground terminals, the second differential signal pair has a third differential terminal and a fourth differential terminal, and a distance between the first differential terminal and the second differential terminal is less than a distance between the third differential terminal and the fourth differential terminal.

In certain embodiments, each of the first differential terminal and the second differential terminal has a first front portion at least partially exposed out of the insulating body, a first connecting portion connected to the first front portion and retained to the insulating body, and a first soldering portion connected to the first connecting portion, each of the third differential terminal and the fourth differential terminal has a second front portion at least partially exposed out of the insulating body, a second connecting portion connected to the second front portion and retained to the insulating body, and a second soldering portion connected to the second connecting portion, and a distance between the two first front portions is less than a distance between the two second front portions.

In certain embodiments, the first front portion comprises a first contact portion and a first extending portion connected to the first contact portion, the first extending portion is connected to the first connecting portion, the second front portion comprises a second contact portion and a second extending portion connected to the second contact portion, the second extending portion is connected to the second connecting portion, and a distance between the two first extending portions is less than a distance between the two second extending portions.

In certain embodiments, a width of the first extending portion is less than a width of the first contact portion, a width of the second extending portion is less than a width of the second contact portion, and the width of the first extending portion of the second differential terminal is greater than the width of the second extending portion of the third differential terminal.

In certain embodiments, a chamfer exists between the first extending portion and the first contact portion, the width of the first extending portion is 0.6 to 0.9 times the width of the first contact portion, and the width of the first extending portion is smoothly reduced backward from front thereof.

In certain embodiments, the second differential terminal is closer to the third differential terminal than the first differential terminal, at least one of the first ground terminals exists between the second differential terminal and the third differential terminal, no ground terminal is provided at a side of the first differential terminal away from the second differential terminal, another one of the first ground terminals is provided at a side of the fourth differential terminal away from the third differential terminal, and a width of the first differential terminal is greater than a width of the fourth differential terminal, or a width of the second differential terminal is greater than a width of the third differential terminal.

Compared with the related art, certain embodiments of the present invention have the following beneficial effects.

By adjusting the structure of the first differential signal pair to be different from the structure of the second differential signal pair, which has the first ground terminals at two sides thereof, the impedance of the first differential signal pair is adjusted, such that the impedance of the first differential signal pair and the impedance of the second differential signal pair are identical to facilitate impedance matching without providing additional grounding member to reduce the impedance of the first differential signal pair, and the only adjustment is applied to the existing terminal structure, such that the connector has a simple structure, processing and assembling are simple, thus saving the cost. Further, the first differential signal pair, which has a side not provided with any ground terminal, the second differential signal pair, which has both sides being provided with the first ground terminals, and the third differential signal pair, which has both sides being provided with the second ground terminals, are provided differently, to prioritize on the premise that the impedances of the two types of the differential signal pairs are identical, and then to consider other issues such as crosstalk and resonance, without considering all issues of the crosstalk, resonance and impedances of all of the differential signal pairs of the electrical connector altogether, thus reducing the design difficulty, facilitating speeding of the production period, and allowing the impedance matching to become better.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
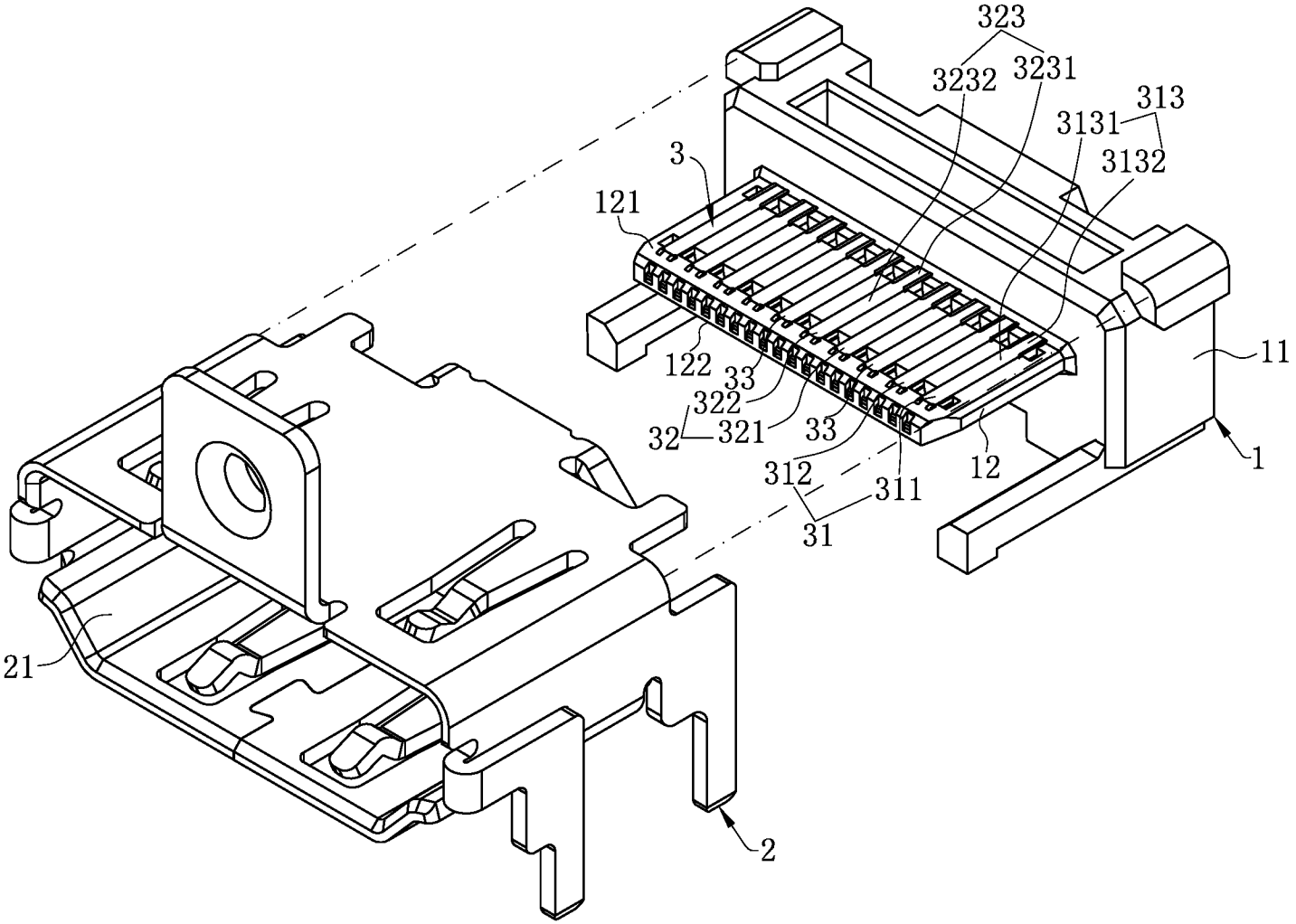
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

Figure 2:
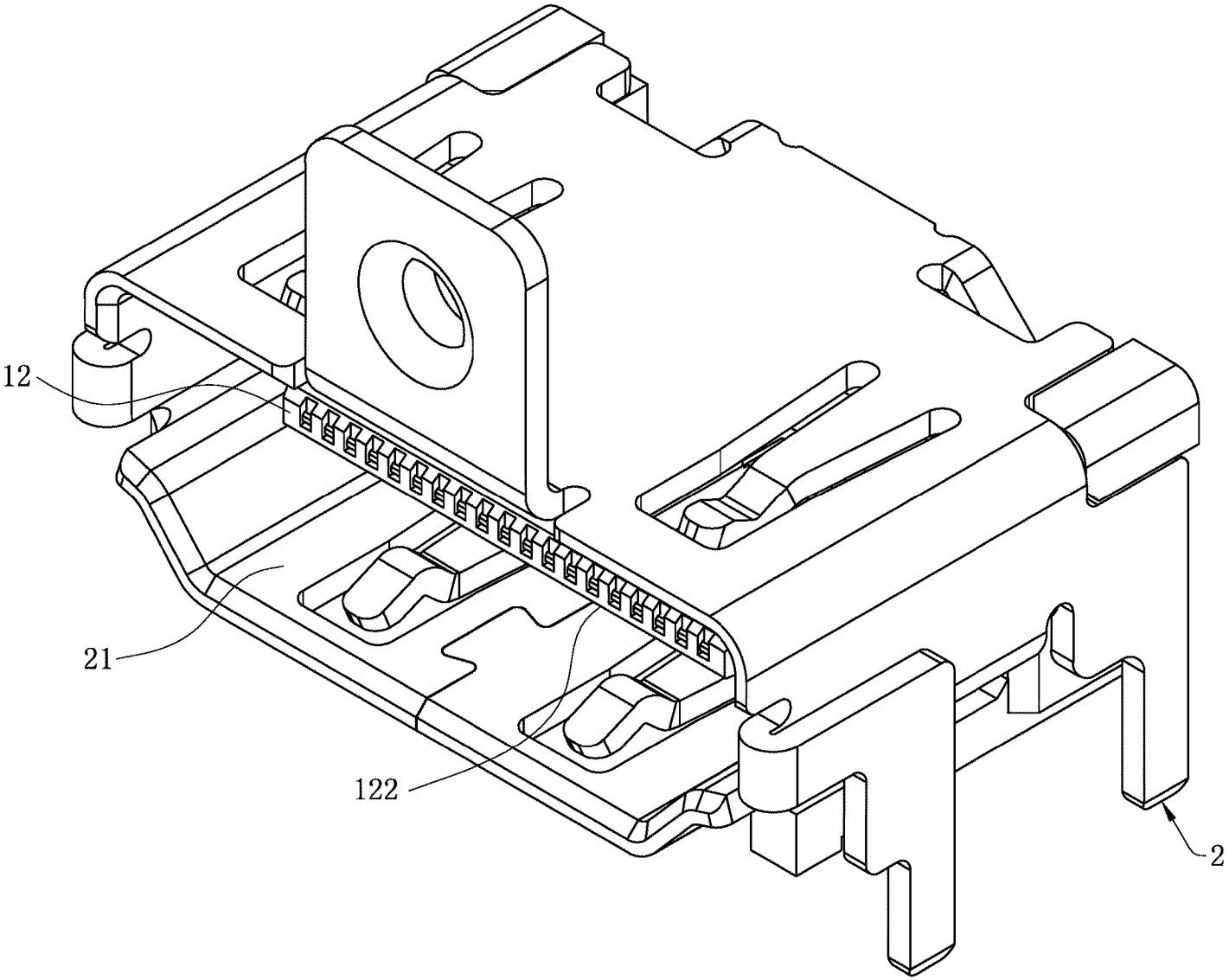
FIG. 2 is a perspective assembled view of an electrical connector according to certain embodiments of the present invention.

FIG. 1 and FIG. 2 show an electrical connector 100 according to certain embodiments of the present invention, which is used to mate and match with a mating connector (not shown). The electrical connector 100 is mounted on a circuit board (not shown). In this embodiment, the electrical connector 100 is an electrical connector transmitting high frequency signals, that is, a HDMI 2.1 connector. In other embodiments, the electrical connector 100 may be other connectors transmitting high frequency signals.

For convenience of description, the mating and matching direction of the electrical connector 100 and the mating connector is defined as a front-rear direction. The electrical connector 100 is mated forward with the mating connector.

Figure 3:
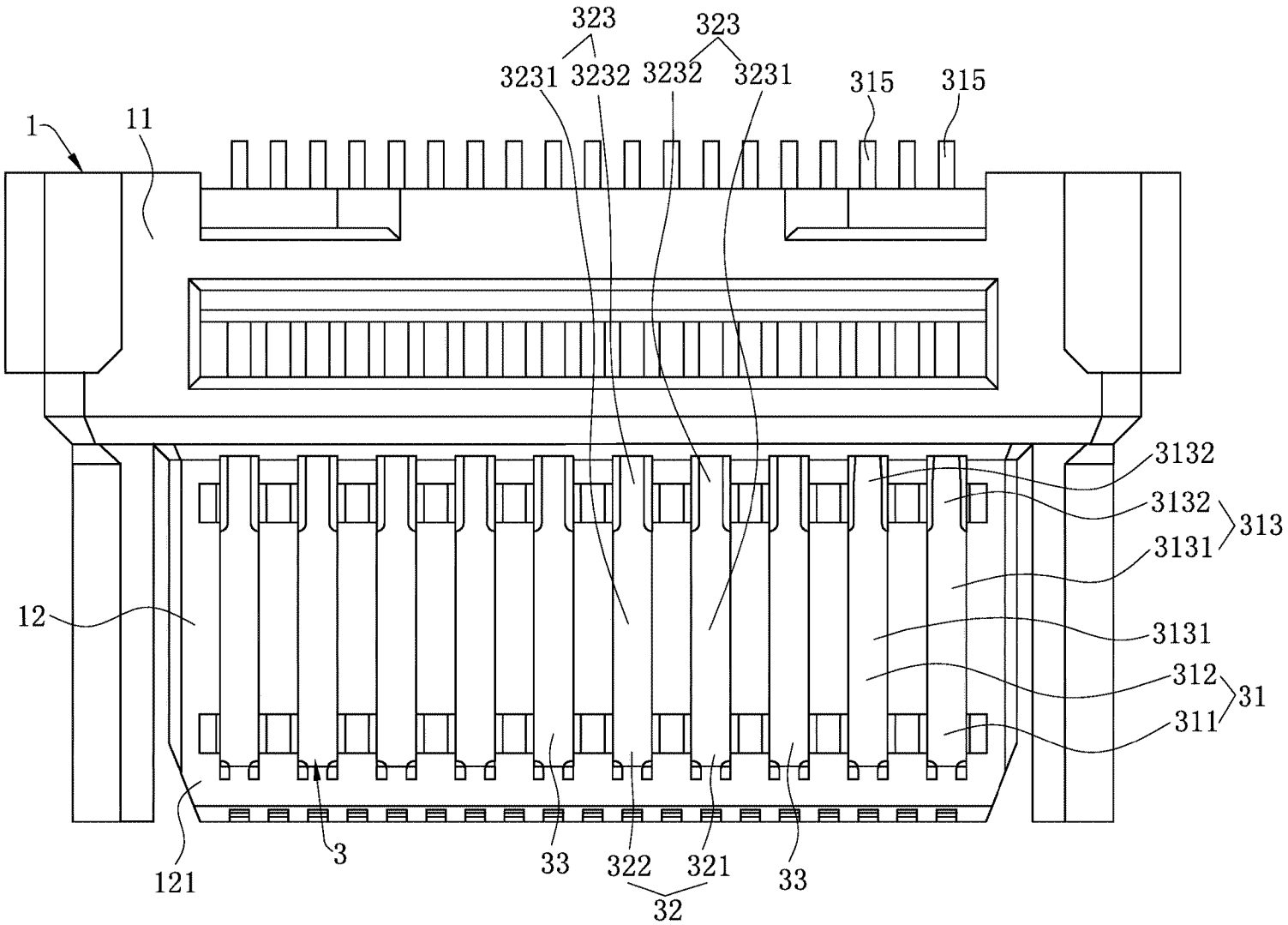
FIG. 3 is a top view of an electrical connector according to certain embodiments of the present invention with its shielding shell being removed.
Figure 4:
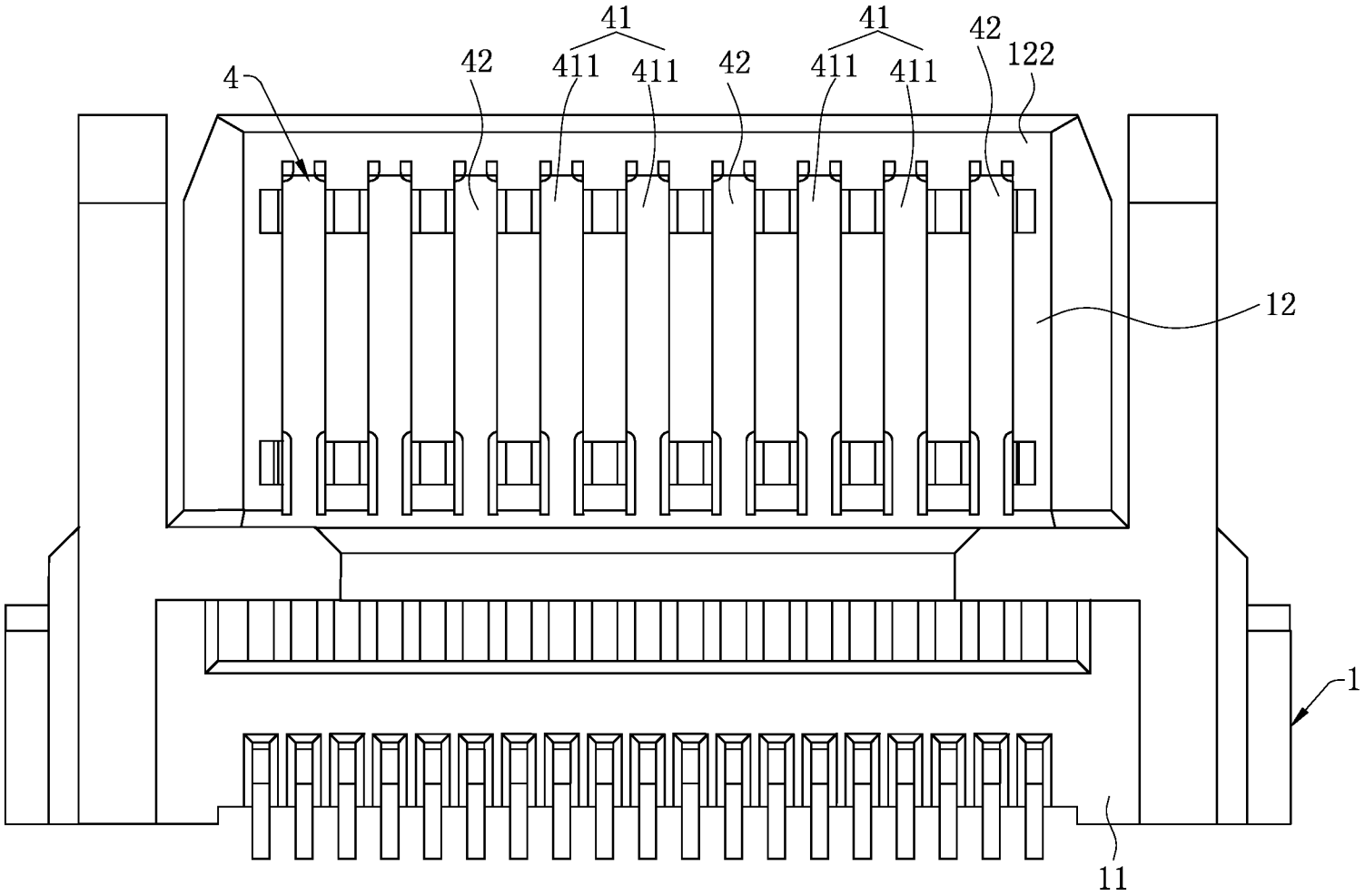
FIG. 4 is a bottom view of an electrical connector according to certain embodiments of the present invention with its shielding shell being removed.

As shown in FIG. 1, FIG. 3 and FIG. 4, the electrical connector 100 includes an insulating body 1. A plurality of first terminals 3 and a plurality of second terminals 4 are formed on the insulating body 1 by one molding. The first terminals 3 and the second terminals 4 are alternately arranged. A shielding shell 2 wraps outside the insulating body 1, and the shielding shell 2 and the insulating body 1 form an insertion cavity 21 therebetween.

The insulating body 1 has a base 11 and a tongue 12 protruding out of the base 11. The tongue 12 is located in the insertion cavity 21. The tongue 12 has an upper surface 121 and a lower surface 122. The first terminals 3 are provided in a row and partially exposed to the upper surface 121 of the tongue 12. The second terminals 4 are provided in a row and partially exposed to the lower surface 122 of the tongue 12.

Figure 5:
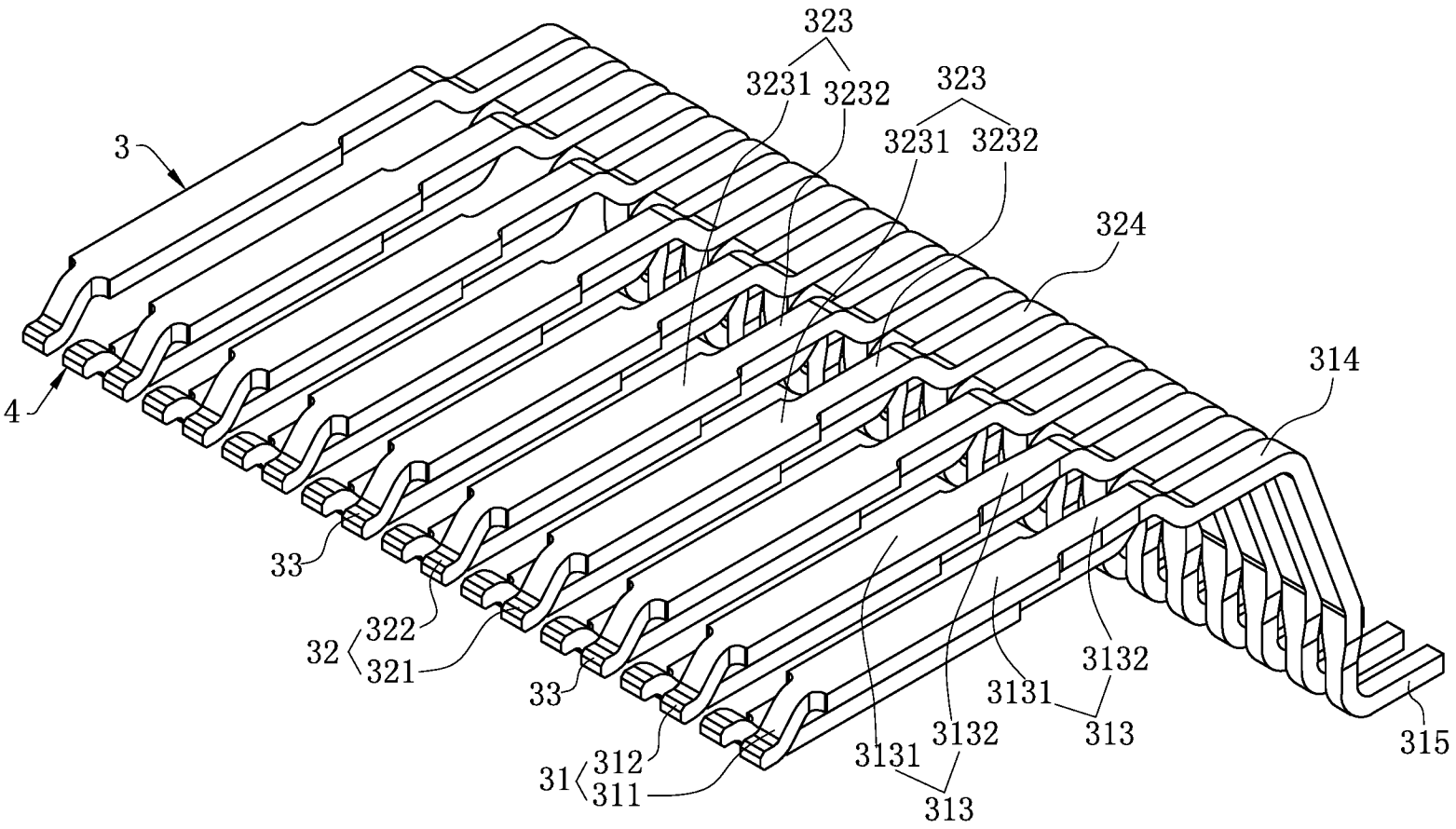
FIG. 5 is a structural schematic view of a plurality of first terminals and a plurality of second terminals according to certain embodiments of the present invention.
Figure 6:
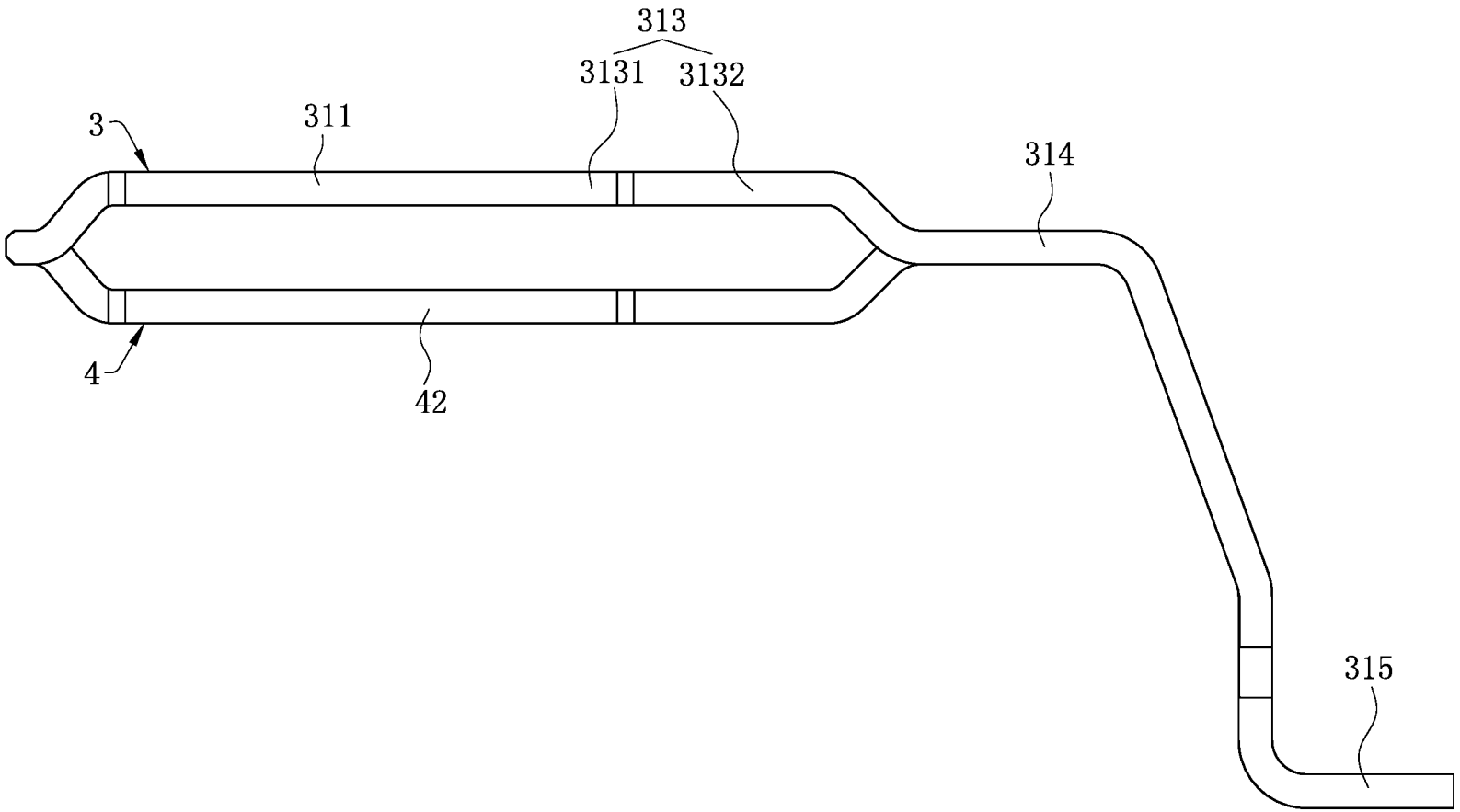
FIG. 6 is a side view of FIG. 5.

As shown in FIG. 3, FIG. 5 and FIG. 6, the first terminals 3 include a first differential signal pair 31, a second differential signal pair 32, and a plurality of first ground terminals 33. The first differential signal pair 31 has a first differential terminal 311 and a second differential terminal 312, and the second differential signal pair 32 has a third differential terminal 321 and a fourth differential terminal 322. The second differential terminal 312 is closer to the third differential terminal 321 than the first differential terminal 311. One of the first ground terminals 33 exists between the second differential terminal 312 and the third differential terminal 321. No ground terminal is provided at a side of the first differential terminal 311 away from the second differential terminal 312. Another one of the first ground terminals 33 is provided at a side of the fourth differential terminal 322 away from the third differential terminal 321. Each of the first differential terminal 311 and the second differential terminal 312 has a first front portion 313, where each of the first front portions 313 is at least partially exposed out of the upper surface 121 of the tongue 12, a first connecting portion 314 connected to the first front portion 313 and retained to the base 11, and a first soldering portion 315 connected to the first connecting portion 314 and extending out of the base 11. Each of the third differential terminal 321 and the fourth differential terminal 322 has a second front portion 323 at least partially exposed out of the upper surface 121 of the tongue 12, a second connecting portion 324 connected to the second front portion 323 and retained to the base 11, and a second soldering portion 325 connected to the second connecting portion 324 and extending out of the base 11.

Figure 7:
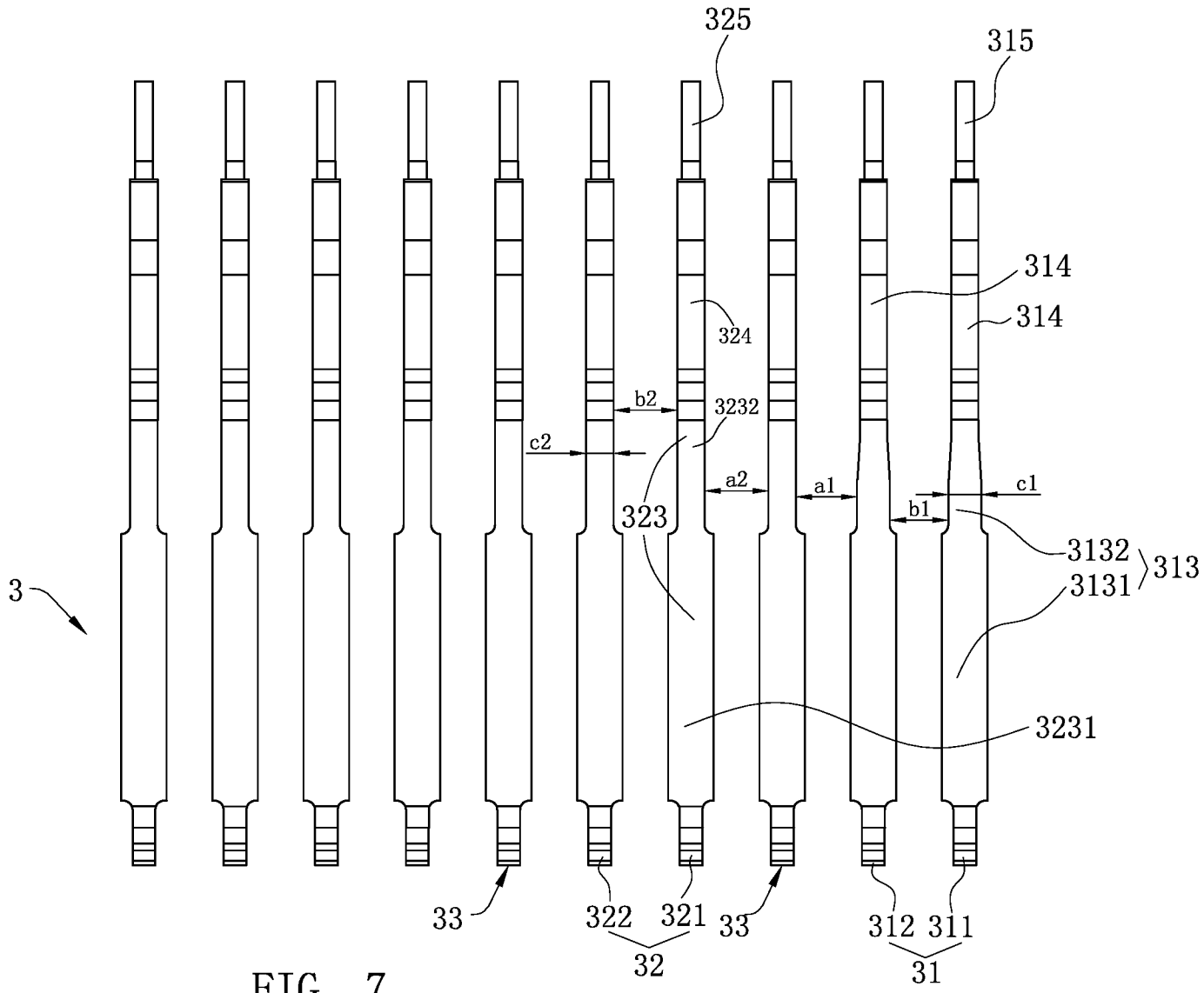
FIG. 7 is a structural schematic view of a plurality of first terminals according to certain embodiments of the present invention.

As shown in FIG. 5 to FIG. 7, the first front portion 313 includes a first contact portion 3131 and a first extending portion 3132 extending horizontally backward from a tail end of the first contact portion 3131. The first connecting portion 314 bends and extends backward and downward from a tail end of the first extending portion 3132. The first soldering portion 315 bends and extends backward from a tail end of the first connecting portion 314. A virtual center axial line of the first contact portion 3131, the first extending portion 3132, the first connecting portion 314 and the first soldering portion 315 of each of the first differential terminal 311 and the second differential terminal 312 is located on a same plane, facilitating the identical signal transmission of the first differential signal pair 31, reducing the fluctuation of the signal transmission, and reducing the effect causing the impedance to increase due to the fluctuation of the virtual center axial lines of the first differential terminal 311 and the second differential terminal 312. The second front portion 323 includes a second contact portion 3231 and a second extending portion 3232 extending horizontally backward from a tail end of the second contact portion 3231. The second connecting portion 324 bends and extends backward and downward from a tail end of the second extending portion 3232. The second soldering portion 325 bends and extends backward from a tail end of the second connecting portion 324. The second contact portion 3231 and the first contact portion 3131 are located at a same first height of the tongue 12, and the second extending portion 3232 and the first extending portion 3132 are located at a same second height of the tongue 12. In this embodiment, the first height is equal to the second height. In other embodiments, the first height and the second height may be different from each other. The second connecting portion 324 and the second soldering portion 325 respectively overlap with projections of the first connecting portion 314 and the first soldering portion 315 along an arrangement direction of the first terminals 3.

As shown in FIG. 7, a distance between the first extending portion 3132 of the second differential terminal 312 and the first ground terminal 33 adjacent thereto is less than a distance between the second extending portion 3232 of the third differential terminal 321 and the first ground terminal 33 adjacent thereto. The distance a1 between the first extending portion 3132 of the second differential terminal 312 and the first ground terminal 33 adjacent thereto is 0.67 mm, and the distance a2 between the second extending portion 3232 of the third differential terminal 321 and the first ground terminal 33 adjacent thereto is 0.7 mm. The first front portion 313 and the second front portion 323 are the portions to be contacted with a mating terminal, and affect the impedance more. By adjusting the distance between the first front portion 313 of the second differential terminal 312 and the first ground terminal 33 adjacent thereto, the impedance may be significantly adjusted. In addition, the first contact portion 3131 is the portion to be firstly contacted with the mating terminal and affects the impedance more than the first extending portion 3132, thus being easily affected by the processing tolerance. If the first contact portion 3131 is adjusted, it is difficult to control the variation value of the impedance, such that the impedance of the first differential signal pair 31 and the impedance of the second differential signal pair 32 may easily not match, thus affecting the transmission of the high frequency signals. Adjusting the first extending portion 3132 may cause a relatively smaller variation value of the impedance, and the impedance of the first extending portion 3132 may be adjusted easily to an ideal value, such that the adjustment may be controlled against the processing tolerance, the adjustment is controlled, which is convenient for design and processing. In other embodiments, it is also possible that a distance between the first contact portion 3131 of the second differential terminal 312 and the first ground terminal 33 adjacent thereto is less than a distance between the second contact portion 3231 of the third differential terminal 321 and the first ground terminal 33 adjacent thereto, or that a distance between the first connecting portion 314 of the second differential terminal 312 and the first ground terminal 33 adjacent thereto is less than a distance between the second connecting portion 324 of the third differential terminal 321 and the first ground terminal 33 adjacent thereto. By making the distance between the second differential terminal 312 and the first ground terminal 33 adjacent thereto be less than the distance between the third differential terminal 321 and the first ground terminal 33 adjacent thereto, the impedance of the first differential signal pair 31 is reduced, such that the impedance of the first differential signal pair 31 and the impedance of the second differential signal pair 32 are identical, thus remedying the deficiency that the impedance of the first differential signal pair 31 is large due to one side of the first differential signal pair 31 not having any ground terminal 5.

As shown in FIG. 7, a width of the first extending portion 3132 is less than a width of the first contact portion 3131, a width of the second extending portion 3232 is less than a width of the second contact portion 3231, the width of the first extending portion 3132 is greater than the width of the second extending portion 3232, the width of the first extending portion 3132 of the second differential terminal 312 is greater than the width of the second extending portion 3232 of the third differential terminal 321, and the width of the first extending portion 3132 of the first differential terminal 311 is greater than the width of the second extending portion 3232 of the fourth differential terminal 322. To prevent the structure of the first differential terminal 311 from greatly changing, a chamfer exists between the first extending portion 3132 and the first contact portion 3131, the width of the first extending portion 3132 is provided to be 0.6 to 0.9 times the width of the first contact portion 3131, and the width of the first extending portion 3132 is smoothly reduced backward from front thereof, thus facilitating the fluency of the signal transmission, facilitating reducing impedance and preventing from excessive impedance variation to generate signal reflection, and facilitating improvement of the high frequency transmission effect. The widths of the first contact portions 3131 of the first differential terminal 311 and the second differential terminal 312 are both 0.5 mm, and the widths c1 of the first extending portions 3132 of the first differential terminal 311 and the second differential terminal 312 are both 0.36 mm, which is 0.72 times the width of the first contact portion 3131. The widths of the second contact portions 3231 of the third differential terminal 321 and the fourth differential terminal 322 are both 0.5 mm, and the widths c2 of the second extending portions 3232 of the third differential terminal 321 and the fourth differential terminal 322 are both 0.3 mm. At this time, the impedance is adjusted altogether according to the distance between the second differential terminal 312 and the first ground terminal 33 adjacent thereto, and by having the width of the first extending portion 3132 of the second differential terminal 312 greater than the width of the second extending portion 3232 of the third differential terminal 321, such that the adjustment methods are increased and become more controlled, preventing the distance between the second differential terminal 312 and the first ground terminal 33 adjacent thereto from being too small, or preventing the width of the first extending portion 3132 from being too wide, facilitating reducing the change of the terminal structure, facilitating the fluency of the signal transmission, facilitating reducing impedance, and allowing the distance between terminals to be more reasonable, which is convenient for processing and mounting. In other embodiments, it is possible that the width of other portions of the first differential terminal 311 is greater than the width of corresponding portions of the fourth differential terminal 322, and/or that the width of other portions of the second differential terminal 312 is greater than the width of the corresponding portions of the third differential terminal 321. The other portions and corresponding portions may be, for example, the first contact portion 3131 corresponding to the second contact portion 3231, the first connecting portion 314 corresponding to the second connecting portion 324, and the first soldering portion 315 corresponding to the second soldering portion 325.

As shown in FIG. 3, a width of a portion of the first extending portion 3132 of the second differential terminal 312 exposed out of the tongue 12 is greater than a width of a portion of the second extending portion 3232 of the third differential terminal 321 exposed out of the tongue 12, and a width of a portion of the first extending portion 3132 of the first differential terminal 311 exposed out of the tongue 12 is greater than a width of a portion of the second extending portion 3232 of the fourth differential terminal 322 exposed out of the tongue 12. Since the dielectric coefficient of air is greater than the dielectric coefficient of the insulating body 1, when the width of a portion of the first extending portion 3132 exposed out of the tongue 12 is greater than the width of a portion of the second extending portion 3232 exposed out of the tongue 12, the corresponding portion of the first extending portion 3132 exposed in the air is more than that of the second extending portion 3232, and the impedance becomes correspondingly smaller. At this time, the portion of the first extending portion 3132 exposed in the air has a smaller impedance than that of the second extending portion 3232, and the width of the first extending portion 3132 by itself is greater than the width of the second extending portion 3232, such that the impedance is further reduced. By reducing the impedance in both ways, the change of the terminal structure due to other methods for reducing the impedance of the first differential signal pair 31 is reduced, and there may be no need to use the other methods to reduce the impedance, such that the terminal structure of the first differential signal pair 31 is not greatly changed, ensuring the fluency of the signal transmission of the first differential signal pair 31, facilitating reducing impedance and preventing from excessive impedance variation to generate signal reflection, facilitating the identical signal transmission of other differential signal pairs, and improving the high frequency transmission effect.

As shown in FIG. 7, a distance between the two first extending portions 3132 is less than a distance between the two second extending portions 3232, combined with the impedance adjusting methods as described above to adjust the impedance of the first differential signal pair 31 altogether, such that the impedance of the first different signal pair 31 is reduced and the structure thereof does not require to be changed significantly, thus facilitating the fluency of the signal transmission, facilitating reducing impedance and preventing from excessive impedance variation to generate signal reflection, and facilitating improvement of the high frequency transmission effect. The distance between the two first extending portions 3132 is 0.64 mm, and the distance between the two second extending portions 3232 is 0.7 mm. In other embodiments, it is possible that the distance between other portions of the first differential terminal 311 and the second differential terminal 312 is less than the distance between the corresponding portions of the third differential terminal 321 and the fourth differential terminal 322. The other portions and corresponding portions may be, for example, the first contact portion 3131 corresponding to the second contact portion 3231, the first connecting portion 314 corresponding to the second connecting portion 324, and the first soldering portion 315 corresponding to the second soldering portion 325.

As shown in FIG. 3, FIG. 5 and FIG. 7, a side edge of the first extending portion 3132 close to the first ground terminal 33 adjacent thereto extends first straightly and then obliquely backward from front thereof, such that the side edge of the first extending portion 3132 close to the first ground terminal 33 adjacent thereto has less change in it shape, reducing the times of the impedance changes while reducing the impedance, and reducing the signal reflection, thus improving the high frequency transmission effect. In addition, in adjusting the impedance, a distance from the straightly extending portion and the obliquely extending portion of the side edge to the first ground terminal 33 adjacent thereto may correspondingly increase or decrease, and the length of each of the straightly extending portion and the obliquely extending portion of the side edge may also change, thus further adjusting the impedance of the first differential terminal 311. The side edge is in a regular shape which extends first straightly and then obliquely, and the impedance change is in a regular pattern, which is convenient to control the impedance change value, facilitating fine tuning of the impedance, and achieving the ideal impedance value. The two side edges of the first extending portion 3132 are provided to be symmetrical about a virtual center axial line of the first extending portion 3132, and both extend first straightly backward from front thereof and then obliquely toward the virtual center axial line of the first extending portion 3132, until a width of the back end of the first extending portion 3132 and a width of the front end of the first connecting portion 314 are identical, such that the overall shape of the first extending portion 3132 is smoothly reduced backward from front thereof, and the change of shape is less. In other embodiments, the side edge of the first extending portion 3132 may be a curved shape, or may be a combination of multiple curves, or a combination of a curve and a straight line, etc., and is not limited herein.

As shown in FIG. 4, the second terminals 4 include two third differential signal pairs 41 and a plurality of second ground terminals 42. Each of two sides of each of the third differential signal pairs 41 is provided with one of the second ground terminals 42. Each of the third differential signal pairs 41 includes two fifth differential terminals 411. Each of the fifth differential terminals 411 has a third front portion 412 partially exposed to the lower surface 122 of the tongue 12, a third connecting portion 413 connected to the third front portion 412 and retained to the base 11, and a third soldering portion 414 connected to the third connecting portion 413. The third front portions 412 of the two third differential signal pairs 41 are located at a same height of the tongue 12. The third connecting portion 413 and the third soldering portion 414 respectively overlap with projections of the first connecting portion 314 and the first soldering portion 315 along the arrangement direction of the first terminals 3. The second contact portion 3231 and the first contact portion 3131 are located at a same first height of the tongue 12, and the second extending portion 3232 and the first extending portion 3132 are located at a same second height of the tongue 12. In this embodiment, the first height is equal to the second height. In other embodiments, the first height and the second height may be different from each other. The second connecting portion 324 and the second soldering portion 325 respectively overlap with projections of the first connecting portion 314 and the first soldering portion 315 along the arrangement direction of the first terminals 3, the third front portions 412 of the two third differential signal pairs 41 are located at the same height of the tongue 12, and the third connecting portion 413 and the third soldering portion 414 respectively overlap with projections of the first connecting portion 314 and the first soldering portion 315 along the arrangement direction of the first terminals 3, thus facilitating the one molding of the first terminals 3, the second terminals 4 and the insulating body 1, reducing the processing cost, and facilitating the identical signal transmission of the differential signal pairs.

As shown in FIG. 3 and FIG. 4, a distance between the two fifth differential terminals 411 of one of the third differential signal pairs 41 is equal to a distance between the two fifth differential terminals 411 of the other of the third differential signal pairs 41. A distance between the two third front portions 412 of each of the third differential signal pairs 41 is equal to the distance between the two second front portions 323, and is greater than the distance between the two first front portions 313. A distance between each of the fifth differential terminals 411 and the second ground terminal 42 adjacent thereto is equal to the distance between the third differential terminal 321 and the first ground terminal 33 adjacent thereto, and is greater than the distance between the second differential terminal 312 and the first ground terminal 33 adjacent thereto. A width of each of the fifth differential terminals 411 is identical to the width of each of the corresponding third differential terminal 321 and the fourth differential terminal 322.

In addition, it should be noted that, in other embodiments, it is also possible only having width of the first extending portion 3132 of the second differential terminal 312 greater than the width of the second extending portion 3232 of the third differential terminal 321, and/or having the width of the first extending portion 3132 of the first differential terminal 311 greater than the width of the second extending portion 3232 of the fourth differential terminal 322. Alternatively, it is possible only having the width of a portion of the first extending portion 3132 of the second differential terminal 312 exposed out of the insulating body 1 greater than the width of a portion of the second extending portion 3232 of the third differential terminal 321 exposed out of the insulating body 1, and/or having the width of a portion of the first extending portion 3132 of the first differential terminal 311 exposed out of the insulating body 1 greater than the width of a portion of the second extending portion 3232 of the fourth differential terminal 322 exposed out of the insulating body 1. Alternatively, it is possible only having a distance between the first differential terminal 311 and the second differential terminal 312 less than a distance between the third differential terminal 321 and the fourth differential terminal 322. Alternatively, the methods described above may be otherwise combined differently from the embodiments as described. By having multiple methods to adjust the impedance of the first differential signal pair 31, the adjustment may be more controlled, structural design of the terminals may be more reasonable, reducing the change of the structure of the first differential terminal 311, facilitating the fluency of the signal transmission, facilitating reducing impedance and preventing from excessive impedance variation to generate signal reflection, and facilitating improvement of the high frequency transmission effect. By adjusting the structure of the first differential signal pair 31 to be different from the structures of the second differential signal pair 32 which respectively have the first ground terminals 33 at two sides thereof and/or the third differential signal pair 41 which respectively have the second ground terminals 42 at two sides thereof, the impedance of the first differential signal pair 31 is adjusted, such that the impedance of the first differential signal pair 31 and the impedance of the second differential signal pair 32 and/or the impedance of the third differential signal pair 41 are identical to facilitate impedance matching without providing additional grounding member to reduce the impedance of the first differential signal pair 31, and the only adjustment is applied to the existing terminal structure, such that the connector has a simple structure, processing and assembling are simple, thus saving the cost. Further, the first differential signal pair 31, which has a side not provided with any ground terminal, and the second differential signal pair 32, which respectively have both sides being provided with the first ground terminals 33, and the third differential signal pair 41, which respectively have both sides being provided with the second ground terminals 42, are provided differently, to prioritize on the premise that the impedances of the two types of the differential signal pairs are identical, and then to consider other issues such as crosstalk and resonance, without considering all issues of the crosstalk, resonance and impedances of all of the differential signal pairs of the electrical connector altogether, thus reducing the design difficulty, facilitating speeding of the production period, and allowing the impedance matching to become better. Accordingly, the values of a1, b1, c1 in FIG. 7 are the result obtained by adjusting the issues such as crosstalk, resonance, stable signal transmission, etc. to the first differential signal pair 31, the second differential signal pair 32 and the third differential signal pair 41 on the premise ensuring that the impedances of the first differential signal pair 31, the second differential signal pair 32 and the third differential signal pair 41 are identical, thus meeting the HDMI 2.1 standard and requirement.

To sum up, the electrical connector according to certain embodiments of the present invention has the following beneficial effects:

(1) By making the distance between the second differential terminal 312 and the first ground terminal 33 adjacent thereto be less than the distance between the third differential terminal 321 and the first ground terminal 33 adjacent thereto, the impedance of the first differential signal pair 31 is reduced, such that the impedance of the first differential signal pair 31 and the impedance of the second differential signal pair 32 are identical, thus remedying the deficiency that the impedance of the first differential signal pair 31 is large due to one side of the first differential signal pair 31 not having any ground terminal 5.

(2) The first front portion 313 and the second front portion 323 are the portions to be contacted with the mating terminal, and affect the impedance more. Thus, the distance between the first front portion 313 of the second differential terminal 312 and the first ground terminal 33 adjacent thereto is less than the distance between the second front portion 323 of the third differential terminal 321 and the first ground terminal 33 adjacent thereto, such that the impedance of the first differential signal pair 31 is significantly reduced, thus achieving better impedance adjusting effect.

(3) The distance between the first extending portion 3132 of the second differential terminal 312 and the first ground terminal 33 adjacent thereto is less than the distance between the second extending portion 3232 of the third differential terminal 321 and the first ground terminal 33 adjacent thereto. The first contact portion 3131 is the portion to be firstly contacted with the mating terminal and affects the impedance more than the first extending portion 3132, thus being easily affected by the processing tolerance. If the first contact portion 3131 is adjusted, it is difficult to control the variation value of the impedance, such that the impedance of the first differential terminal 311 and the impedance of the second differential terminal 312 may easily not match, thus affecting the transmission of the high frequency signals. Adjusting the first extending portion 3132 may cause a relatively smaller variation value of the impedance, and the impedance of the first extending portion 3132 may be adjusted easily to an ideal value, such that the adjustment may be controlled against the processing tolerance, the adjustment is controlled, which is convenient for design and processing.

(4) On the basis that the impedance of the first differential signal pair 31 is reduced by having the distance between the first extending portion 3132 of the second differential terminal 312 and the first ground terminal 33 adjacent thereto less than the distance between the second extending portion 3232 of the third differential terminal 321 and the first ground terminal 33 adjacent thereto, the width of the first extending portion 3132 of the second differential terminal 312 is greater than the width of the second extending portion 3232 of the third differential terminal 321, and the width of the first extending portion 3132 of the first differential terminal 311 is greater than the width of the second extending portion 3232 of the fourth differential terminal 322, thus facilitating the adjusting of the first differential signal pair 31, reducing the impedance of the first differential signal pair 31, such that the adjustment methods are increased and become more controlled, preventing the distance between the second differential terminal 312 and the first ground terminal 33 adjacent thereto from being too small, or preventing the width of the first extending portion 3132 from being too wide, facilitating reducing the change of the terminal structure, facilitating the fluency of the signal transmission, facilitating reducing impedance, and allowing the distance between terminals to be more reasonable, which is convenient for processing and mounting.

(5) A chamfer exists between the first extending portion 3132 and the first contact portion 3131, thus forming a buffer, reducing the change of the structure of the first differential terminal 311. Further, the width of the first extending portion 3132 is 0.6 to 0.9 times the width of the first contact portion 3131, and the width of the first extending portion 3132 is smoothly reduced backward from front thereof, thus preventing the structures of the first extending portion 3132 and the first contact portion 3131 from greatly changing, facilitating the fluency of the signal transmission, facilitating reducing impedance and preventing from excessive impedance variation to generate signal reflection, and facilitating improvement of the high frequency transmission effect.

(6) A side edge of the first extending portion 3132 close to the first ground terminal 33 adjacent thereto extends first straightly and then obliquely backward from front thereof, such that the side edge of the first extending portion 3132 close to the first ground terminal 33 adjacent thereto has less change in it shape, reducing the times of the impedance changes while reducing the impedance, and reducing the signal reflection, thus improving the high frequency transmission effect. In addition, in adjusting the impedance, a distance from the straightly extending portion and the obliquely extending portion of the side edge to the first ground terminal 33 adjacent thereto may correspondingly increase or decrease, and the length of each of the straightly extending portion and the obliquely extending portion of the side edge may also change, thus further adjusting the impedance of the first differential terminal 311. The side edge is in a regular shape which extends first straightly and then obliquely, and the impedance change is in a regular pattern, which is convenient to control the impedance change value, facilitating fine tuning of the impedance, and achieving the ideal impedance value.

(7) On the basis that the impedance of the first differential signal pair 31 is reduced by having the distance between the first extending portion 3132 of the second differential terminal 312 and the first ground terminal 33 adjacent thereto less than the distance between the second extending portion 3232 of the third differential terminal 321 and the first ground terminal 33 adjacent thereto, and/or on the basis that the width of the first extending portion 3132 of the second differential terminal 312 is greater than the width of the second extending portion 3232 of the third differential terminal 321, and the width of the first extending portion 3132 of the first differential terminal 311 is greater than the width of the second extending portion 3232 of the fourth differential terminal 322, further having the width of the first differential terminal 311 greater than the width of the fourth differential terminal 322, and/or having the width of the second differential terminal 312 greater than the width of the third differential terminal 321. By two or more of the impedance adjustment methods, the impedance of the first differential signal pair 31 is reduced altogether, thus preventing from a single adjustment to cause the terminal structures of the first differential signal pair 31 to greatly change, facilitating the fluency of the signal transmission, facilitating reducing impedance, and allowing the distance between terminals to be more reasonable, which is convenient for processing and mounting, such that the impedance adjustment becomes more controlled.

(8) Since the dielectric coefficient of air is greater than the dielectric coefficient of the insulating body 1, when the width of a portion of the first front portion 313 of the second differential terminal 312 exposed out of the insulating body 1 is greater than the width of a portion of the second front portion 323 of the third differential terminal 321 exposed out of the insulating body 1, the corresponding portion of the first front portion 313 exposed in the air is more than that of the second front portion 323, and the impedance becomes correspondingly smaller. At this time, the portion of the first front portion 313 exposed in the air has a smaller impedance than that of the second front portion 323, and the width of the first front portion 313 by itself is greater than the width of the second front portion 323, such that the impedance is further reduced. By reducing the impedance in both ways, the change of the terminal structure due to other methods for reducing the impedance of the first differential signal pair 31 is reduced, and there may be no need to use the other methods to reduce the impedance, such that the terminal structure of the first differential signal pair 31 is not greatly changed, ensuring the fluency of the signal transmission of the first differential signal pair 31, facilitating reducing impedance and preventing from excessive impedance variation to generate signal reflection, facilitating improvement of the high frequency transmission effect and the identical signal transmission of other differential signal pairs, and improving the high frequency transmission effect. In addition, the first front portion 313 and the second front portion 323 are the portions to be contacted with the ground terminal, thus easily and significantly affecting the impedance adjustment, and further preventing the first differential signal pair 31 from greatly changing. Thus, the impedance of the first differential signal pair 31 and the impedance of the second differential signal pair 32 are identical, thus remedying the deficiency that the impedance is not identical due to one side of the first differential signal pair 31 not having any ground terminal.

(9) By having the distance between the first differential terminal 311 and the second differential terminal 312 less than the distance between the third differential terminal 321 and the fourth differential terminal 322, the impedance of the first differential signal pair 31 is adjusted, such that the impedance of the first differential signal pair 31 and the impedance of the second differential signal pair 32 are identical, thus remedying the deficiency that the impedance is not identical due to one side of the first differential signal pair 31 not having any ground terminal.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body; and a plurality of first terminals, accommodated in the insulating body, and comprising a first differential signal pair, a second differential signal pair, and a plurality of first ground terminals, wherein the first differential signal pair has a first differential terminal and a second differential terminal, the second differential signal pair has a third differential terminal and a fourth differential terminal, the second differential terminal is closer to the third differential terminal than the first differential terminal, one of the first ground terminals exists between and is adjacent to the second differential terminal and the third differential terminal, no ground terminal is provided at a side of the first differential terminal away from the second differential terminal, another one of the first ground terminals is provided at a side of the fourth differential terminal away from the third differential terminal, and a distance between the second differential terminal and the one of the first ground terminals adjacent thereto is less than a distance between the third differential terminal and the one of the first ground terminals adjacent thereto.

2. The electrical connector according to claim 1, wherein each of the first differential terminal and the second differential terminal has a first front portion at least partially exposed out of the insulating body, a first connecting portion connected to the first front portion and retained to the insulating body, and a first soldering portion connected to the first connecting portion, each of the third differential terminal and the fourth differential terminal has a second front portion at least partially exposed out of the insulating body, a second connecting portion connected to the second front portion and retained to the insulating body, and a second soldering portion connected to the second connecting portion, and a distance between the first front portion of the second differential terminal and the one of the first ground terminals adjacent thereto is less than a distance between the second front portion of the third differential terminal and the one of the first ground terminals adjacent thereto.

3. The electrical connector according to claim 2, wherein the first front portion comprises a first contact portion and a first extending portion connected to the first contact portion, the first extending portion is connected to the first connecting portion, the second front portion comprises a second contact portion and a second extending portion connected to the second contact portion, the second extending portion is connected to the second connecting portion, and a distance between the first extending portion of the second differential terminal and the one of the first ground terminals adjacent thereto is less than a distance between the second extending portion of the third differential terminal and the one of the first ground terminals adjacent thereto.

4. The electrical connector according to claim 3, wherein a width of the first extending portion is less than a width of the first contact portion, a width of the second extending portion is less than a width of the second contact portion, and the width of the first extending portion is greater than the width of the second extending portion.

5. The electrical connector according to claim 3, wherein a chamfer exists between the first extending portion and the first contact portion, the width of the first extending portion is 0.6 to 0.9 times the width of the first contact portion, and the width of the first extending portion is smoothly reduced backward from front thereof.

6. The electrical connector according to claim 3, wherein a side edge of the first extending portion close to the one of the first ground terminals adjacent thereto extends straightly and then obliquely backward from front thereof.

7. The electrical connector according to claim 2, wherein the insulating body has a base and a tongue protruding out of the base, the first terminals are arranged in a row and partially exposed to an upper surface of the tongue, each of the first front portions is at least partially exposed to the upper surface of the tongue, at least some of the second front portions are exposed to the upper surface of the tongue, the first connecting portion and the second connecting portion are retained to the base, and a distance between the two first front portions is less than a distance between the two second front portions.

8. The electrical connector according to claim 7, wherein the first front portion comprises a first contact portion and a first extending portion connected to the first contact portion, the first extending portion is connected to the first connecting portion, the second front portion comprises a second contact portion and a second extending portion connected to the second contact portion, the second extending portion is connected to the second connecting portion, the first extending portion extends horizontally backward from a tail end of the first contact portion, the first connecting portion bends and extends backward and downward from a tail end of the first extending portion, the first soldering portion bends and extends backward from a tail end of the first connecting portion, the second contact portion and the first contact portion are located at a same first height of the tongue, the second extending portion and the first extending portion are located at a same second height of the tongue, and the second connecting portion and the second soldering portion respectively overlap with projections of the first connecting portion and the first soldering portion along an arrangement direction of the first terminals.

9. The electrical connector according to claim 8, further comprising a plurality of second terminals, wherein each of the second terminals is alternately arranged with the first terminals, the second terminals are arranged in a row and partially exposed to a lower surface of the tongue, the second terminals comprise two third differential signal pairs and a plurality of second ground terminals, each of two sides of each of the third differential signal pairs is provided with one of the second ground terminals, each of the third differential signal pairs comprises two fifth differential terminals, each of the fifth differential terminals has a third front portion at least partially exposed to the lower surface of the tongue, a third connecting portion connected to the third front portion and retained to the base, and a third soldering portion connected to the third connecting portion, the third front portions of the two third differential signal pairs are located at a same height of the tongue, the third connecting portion and the third soldering portion respectively overlap with projections of the first connecting portion and the first soldering portion along the arrangement direction of the first terminals, a distance between each of the fifth differential terminals and a corresponding one of the second ground terminals adjacent thereto is equal to the distance between the third differential terminal and the one of the first ground terminals adjacent thereto, and is greater than the distance between the second differential terminal and the one of the first ground terminals adjacent thereto.

10. The electrical connector according to claim 1, wherein a width of the first differential terminal is greater than a width of the fourth differential terminal, or a width of the second differential terminal is greater than a width of the third differential terminal.

11. An electrical connector, comprising:

an insulating body; and a plurality of first terminals, accommodated in the insulating body, and comprising a first differential signal pair, a second differential signal pair, and a plurality of first ground terminals, wherein the first differential signal pair has a first differential terminal and a second differential terminal, the second differential signal pair has a third differential terminal and a fourth differential terminal, the second differential terminal is closer to the third differential terminal than the first differential terminal, at least one of the first ground terminals exists between the second differential terminal and the third differential terminal, no ground terminal is provided at a side of the first differential terminal away from the second differential terminal, and another one of the first ground terminals is provided at a side of the fourth differential terminal away from the third differential terminal;

wherein each of the first differential terminal and the second differential terminal has a first front portion at least partially exposed out of the insulating body, a first connecting portion connected to the first front portion and retained to the insulating body, and a first soldering portion connected to the first connecting portion, each of the third differential terminal and the fourth differential terminal has a second front portion at least partially exposed out of the insulating body, a second connecting portion connected to the second front portion and retained to the insulating body, and a second soldering portion connected to the second connecting portion, and a width of a portion of the first front portion of the second differential terminal exposed out of the insulating body is greater than a width of a portion of the second front portion of the third differential terminal exposed out of the insulating body.

12. The electrical connector according to claim 11, wherein the first front portion comprises a first contact portion and a first extending portion connected to the first contact portion, the first extending portion is connected to the first connecting portion, the second front portion comprises a second contact portion and a second extending portion connected to the second contact portion, the second extending portion is connected to the second connecting portion, a width of the first extending portion is less than a width of the first contact portion, a width of the second extending portion is less than a width of the second contact portion, and a width of a portion of the first extending portion exposed out of the insulating body is greater than a width of a portion of the second extending portion exposed out of the insulating body.

13. The electrical connector according to claim 12, wherein a chamfer exists between the first extending portion and the first contact portion, the width of the first extending portion is 0.6 to 0.9 times the width of the first contact portion, and the width of the first extending portion is smoothly reduced backward from front thereof.

14. The electrical connector according to claim 12, wherein a distance between the two first extending portions is less than a distance between the two second extending portions.

15. An electrical connector, comprising:

an insulating body; and a plurality of first terminals, accommodated in the insulating body, and comprising a first differential signal pair, a second differential signal pair, and a plurality of first ground terminals, wherein one side of the first differential signal pair is not provided with any ground terminal, the first differential signal pair has a first differential terminal and a second differential terminal, each of two sides of the second differential signal pair is provided with one of the first ground terminals, the second differential signal pair has a third differential terminal and a fourth differential terminal, and a distance between the first differential terminal and the second differential terminal is less than a distance between the third differential terminal and the fourth differential terminal.

16. The electrical connector according to claim 15, wherein each of the first differential terminal and the second differential terminal has a first front portion at least partially exposed out of the insulating body, a first connecting portion connected to the first front portion and retained to the insulating body, and a first soldering portion connected to the first connecting portion, each of the third differential terminal and the fourth differential terminal has a second front portion at least partially exposed out of the insulating body, a second connecting portion connected to the second front portion and retained to the insulating body, and a second soldering portion connected to the second connecting portion, and a distance between the two first front portions is less than a distance between the two second front portions.

17. The electrical connector according to claim 16, wherein the first front portion comprises a first contact portion and a first extending portion connected to the first contact portion, the first extending portion is connected to the first connecting portion, the second front portion comprises a second contact portion and a second extending portion connected to the second contact portion, the second extending portion is connected to the second connecting portion, and a distance between the two first extending portions is less than a distance between the two second extending portions.

18. The electrical connector according to claim 17, wherein a width of the first extending portion is less than a width of the first contact portion, a width of the second extending portion is less than a width of the second contact portion, and the width of the first extending portion of the second differential terminal is greater than the width of the second extending portion of the third differential terminal.

19. The electrical connector according to claim 17, wherein a chamfer exists between the first extending portion and the first contact portion, the width of the first extending portion is 0.6 to 0.9 times the width of the first contact portion, and the width of the first extending portion is smoothly reduced backward from front thereof.

20. The electrical connector according to claim 15, wherein the second differential terminal is closer to the third differential terminal than the first differential terminal, at least one of the first ground terminals exists between the second differential terminal and the third differential terminal, no ground terminal is provided at a side of the first differential terminal away from the second differential terminal, another one of the first ground terminals is provided at a side of the fourth differential terminal away from the third differential terminal, and a width of the first differential terminal is greater than a width of the fourth differential terminal, or a width of the second differential terminal is greater than a width of the third differential terminal.

* * * * *